United States Patent [19]

Lodi et al.

[11] Patent Number: 4,575,301

[45] Date of Patent: Mar. 11, 1986

[54] AUTOMATIC FEEDER DEVICE FOR CIGARETTES AND SIMILAR ROD-LIKE ARTICLES

[75] Inventors: Oliviero Lodi, Sasso Marconi; Gianni Armaroli, Bologna, both of Italy

[73] Assignee: Sasib S.p.A., Bologna, Italy

[21] Appl. No.: 545,044

[22] Filed: Oct. 21, 1983

[30] Foreign Application Priority Data

Oct. 22, 1982 [IT] Italy ..... 12645 A/82

[51] Int. Cl.[4] ..... B65B 19/04

[52] U.S. Cl. ..... 414/411; 414/420; 414/421

[58] Field of Search ..... 414/403, 411, 419–422, 414/414, 424, 425, 303; 198/409

[56] References Cited

U.S. PATENT DOCUMENTS

| | | | |
|---|---|---|---|
| 2,799,413 | 7/1957 | Innocenti | 414/414 |
| 3,127,039 | 3/1964 | Christiansen | 414/420 |
| 3,283,930 | 11/1966 | Cascio et al. | 414/403 X |
| 3,298,549 | 1/1967 | Schmermund | 414/414 |
| 3,527,369 | 9/1970 | Bornfleth et al. | 414/414 |
| 3,655,080 | 4/1972 | Gianese | 414/414 |
| 3,672,522 | 6/1972 | Wahle et al. | 414/421 |
| 3,703,242 | 11/1972 | Marradi | 414/414 |
| 3,883,017 | 5/1975 | Shirai et al. | 414/414 |
| 3,910,433 | 10/1975 | Love | 414/420 X |
| 4,303,366 | 12/1981 | Hinchcliffe et al. | 414/419 |
| 4,455,117 | 6/1984 | Cartoceti | 414/420 X |

*Primary Examiner*—Joseph E. Valenza
*Assistant Examiner*—David A. Bucci
*Attorney, Agent, or Firm*—Spencer & Frank

[57] ABSTRACT

An automatic feeder device for loading full trays over the hopper of machines for packing cigarettes and for discharging empty trays from the hopper, with the aid of a tray-carrying casing which is provided with a gate for closing the tray mouth and with tray-holding arms cooperating with the bottom of the tray. The device includes a path (4) for feeding full trays (2'), this path being directed towards the hopper (1), and a path (6) for discharging empty trays (2''), the discharge path being arranged below the tray-feeding path and being directed away from the hopper. A loading-and-unloading inclined frame (8-8, 9, 10) extends adjacent the paths and has an upper fore end which is disposed adjacent the hopper. The frame is swingably mounted so that it can alternately assume two angular positions: a less inclined position in which its upper fore end is lowered toward the inlet of the hopper, and another more inclined position in which its upper fore end is lifted from the inlet of the hopper. The tray-carrying casing is so mounted as to be both longitudinally slidable and rotatable with respect to the frame, from an overturned upper position over the inlet of the hopper, through an upstanding intermediate position where the empty tray is released to the discharge path, to an upstanding lower position where a full tray is received from the tray-feeding path, and then back to the hopper.

9 Claims, 8 Drawing Figures

AUTOMATIC FEEDER DEVICE FOR CIGARETTES AND SIMILAR ROD-LIKE ARTICLES

BACKGROUND AND SUMMARY OF THE INVENTION

The present invention relates to machines for packing cigarettes or any like rod-like articles, and has for its object an automatic feeder device for charging the full trays over the hopper of said packing machines, and for discharging the empty trays from said hopper, by the aid of a tray-carrying casing provided with a gate for closing the tray mouth, and with tray-molding means cooperating with the bottom of the tray.

The invention has for its object to realize an automatic feeder device of the aforementioned type, presenting a simple, sturdy and not too cumbersome construction, and guaranteeing a safe and sufficiently quick operation.

According to the invention, this object is attained by the provision of an automatic feeder device of the above mentioned type comprising a path for the feeding of the full trays, which is directed towards the hopper, and a path for the discharge of the empty trays, which is arranged below the tray-feeding path and is directed away from the hopper, a loading-and-unloading inclined frame being so provided that its longitudinal side members extend laterally to the paths for the feeding and the discharge of the trays, in the forward upward direction as far as above the inlet opening of the hopper, which frame is mounted for a swinging movement around a transversely extending axis, so that it is alternately caused to assume two angular positions: a less inclined position in which its fore end is lowered toward the inlet opening of the hopper, and another more inclined position in which its fore end is lifted up from the inlet opening of the hopper, the tray-carrying casing being so mounted as to be longitudinally slidable, and at the same time rotatable around an axis transversely extending between the longitudinal side members of the loading/unloading frame; actuation and control means being provided, which determine the following operation:

Starting from a position in which the loading/unloading oscillating frame is located in the angular position in which its upper fore end is at a lower level, and the tray-carrying casing is disposed in the overturned advanced position, so that it keeps the tray with its downwardly turned open mouth over the inlet opening of the hopper, after the said tray has been emptied, the loading/unloading frame is moved into the angular position in which its upper fore end is at a higher level, whereby the tray-carrying casing is lifted up from the hopper inlet opening, whereupon the tray-carrying casing is caused to descend, that is to say, to run back in the downward direction along the said frame, and it is at the same time caused to rotate about itself around the transversely extending axis, so as to set again the empty tray in upstanding position. On completion of this rotational movement of the tray-carrying casing, the tray-holding means are de-actuated, whereby the empty tray falls out of the tray-carrying casing, down onto the tray-discharge path, while the tray-carrying casing continues its downward movement along the loading/unloading inclined frame, until it engages the first full tray at stand-by on the tray-feeding path, and withdraws this tray through the activation of the tray-holding means.

Subsequently, the tray-carrying casing is caused to go up, that is to say, it runs forwardly upward on the inclined loading-and-unloading frame while being simultaneously rotated, at least temporaneously, about itself around the transversely extending axis, whereby the so supported full tray is capsized and its closed mouth is turned downward. When the tray-carrying casing is located in the advanced over-turned position over the inlet opening of the hopper, the loading/unloading oscillating frame is swung into its angular position in which its upper fore end is at a lower level, thus bringing down the tray-carrying casing over the inlet opening of the hopper, whereupon the mouth of the tray will be opened.

The feeder device of the invention can be used in any packing machines, particularly also for placing only one full tray over he inlet opening of the hopper, and for removing the said tray after is has been emptied, and for replacing same with another full tray. In this case, the inlet opening of the hopper has a width substantially corresponding to the width of one tray.

Preferably, however, and in a particularly advantageous manner, the device according to the invention is used for carrying out the feeding method according to U.S. Pat. No. 4,530,633. This method consists in placing over the inlet opening of a hopper having a width which is twice the width of a conventional hopper, two trays set into an aligned relation across the width thereof, and in alternately allowing the descent of the cigarettes into the hopper in correspondence of only one of said trays, until this tray is emptied, while in the meantime the previously emptied tray is replaced by a full tray. In this case, two feeder devices according to the invention are associated with the hopper in a side-by-side relation, and each one of these devices is associated to one half of the hopper.

BRIEF DESCRIPTION OF THE DRAWINGS

The above and other characteristic features of the invention, and the advantages arising therefrom will appear from the following description of one preferred embodiment thereof, diagrammatically shown by way of a non-limiting example in the accompanying drawings, in which.

DESCRIPTION OF THE PREFERRED EMBODIMENT

Figure 3:
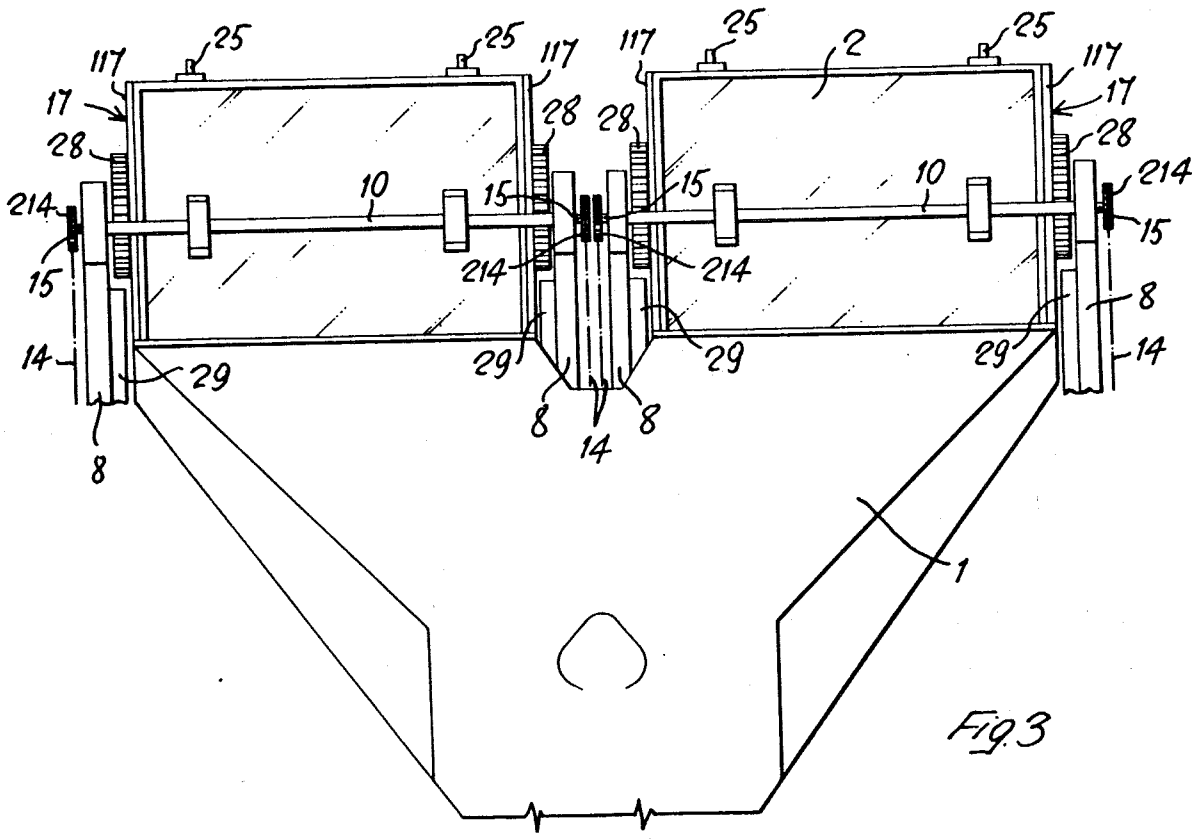
FIG. 3 is a front elevational view of the hopper of a cigarette-packing machine, in which two aligned trays are situated over the inlet opening of the hopper and are each associated with a feeder device according to the invention.

In the Figures, numeral 1 denotes the hopper of a cigarette-packing machine. The inlet opening of this hopper 1 presents a double width, that is, a width which is such as to render it possible to set thereover two trays 2, in an aligned relation across the width of the hopper, as it appears evident from FIG. 3.

As described in U.S. Pat. No. 4,530,633, the descent of the cigarettes into the hopper 1 is alternately allowed in correspondence of only one of the two superposed aligned trays 2, while in the meantime the previously emptied other tray will be replaced by a full tray.

To each half of the inlet opening of the hopper 1 there is associated an automatic feeder device for removing the emptied tray 2 from the hopper, and for substituting it with a full tray. These two feeder devices are equal the one to the other, so that only one of them will be described here.

Each feeder device comprises a frame 3 which is arranged behind the hopper 1, in correspondence of the respective half of the hopper inlet opening.

Onto the said frame there are provided a conveyor 4 for the feeding of the full trays 2', directed toward the hopper 1, and an underlying conveyor 5 for the discharge of the empty trays 2", which move away from the hopper 1. The conveyor 4 for the feeding of the full trays 2' terminates at a distance from hopper 1, and in correspondence of its leading end there is provided a pair of microswitches M1 which can be activated by the first tray 2' of the file of full trays 2', that is being formed on the tray-feeding conveyor 4. A chute 6 for the empty trays 2" extends from a point located between the hopper 1 and the leading end of the tray-feeding conveyor 4, down to the conveyor 5 for the discharge of the empty trays 2". Between the chute 6 and the discharge conveyor 5 there is provided a transferring device 7 in form of a rocker arm, which is pivotally mounted for a rocking movement around the transversely extending axis of pivot 107, and which is adapted for receiving from chute 6 a tray 2" lying in a recumbent position, and for transferring same onto the conveyor 5 in an upstanding position, as it is clearly apparent in FIGS. 1 and 2.

At both sides of frame 3 and of the two conveyors 4, 5 there is provided an oscillating longitudinal side frame member 8, obliquely arranged so as to point upwardly toward hopper 1, and extending by its upper fore end above the inlet opening of hopper 1, and by its rear lower end above the conveyor 5 for the discharge of the empty trays 2". The two longitudinal members 8 are swingably mounted about a transversely extending common axis 108 and are interconnected by means of cross members 9 and 10, so that an oscillating, loading and unloading inclined single frame is thus formed.

Onto a longitudinal guide member 11 fastened to each longitudinal side frame member 8, a slide 12 is slidably mounted, and by a pneumatic cylinder 13 is caused to slide to and fro along the guide member 11 and the frame member 8, which cylinder 13 is fixedly mounted onto member 8 and has its stem 113 connected to the slide 12. To mutually synchronize the movements of both slides 12, these slides are kinematically connected the one to the other in any suitable manner. In the shown embodiment, each slide 12 is secured to an endless chain 14 led around two idle sprocket wheels 114 and 214, mounted in a freely rotatable manner onto the respective side frame member 8. The fore sprocket wheel 214 is secured to a shaft 15 extending through the interior of the fore tubular cross member 10 to the opposite side of the loading/unloading oscillating frame 8—8, 9, 10, where onto the same shaft 15 there is secured the idle sprocket wheel 214 for the chain 14 bound to the other slide 12. At least one of the two slides 12 carries an abutment member 16 that cooperates with two limit microswitches M2 and M3 and with an intermediate microswitch M4, fastened to the respective side frame member 8.

Figure 1:
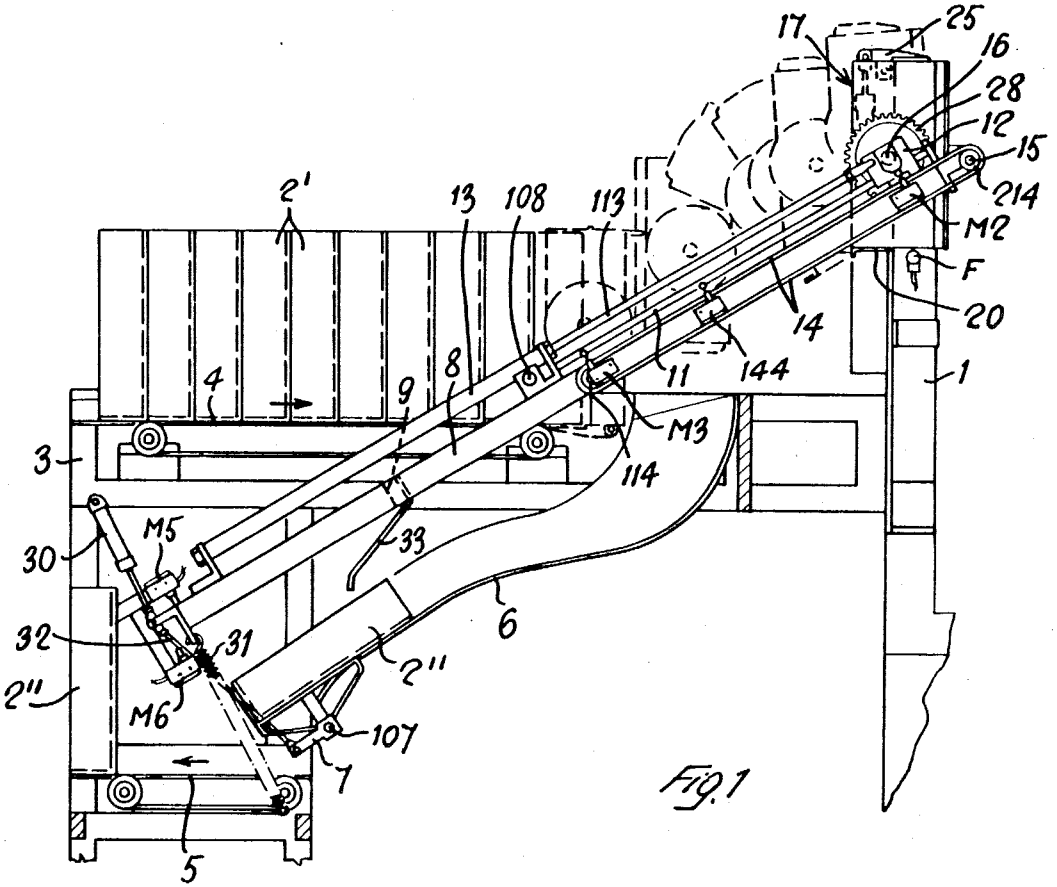
FIGS. 1 and 2 are side elevational views showing a feeder device according to the invention, in two different operative positions.
Figure 2:
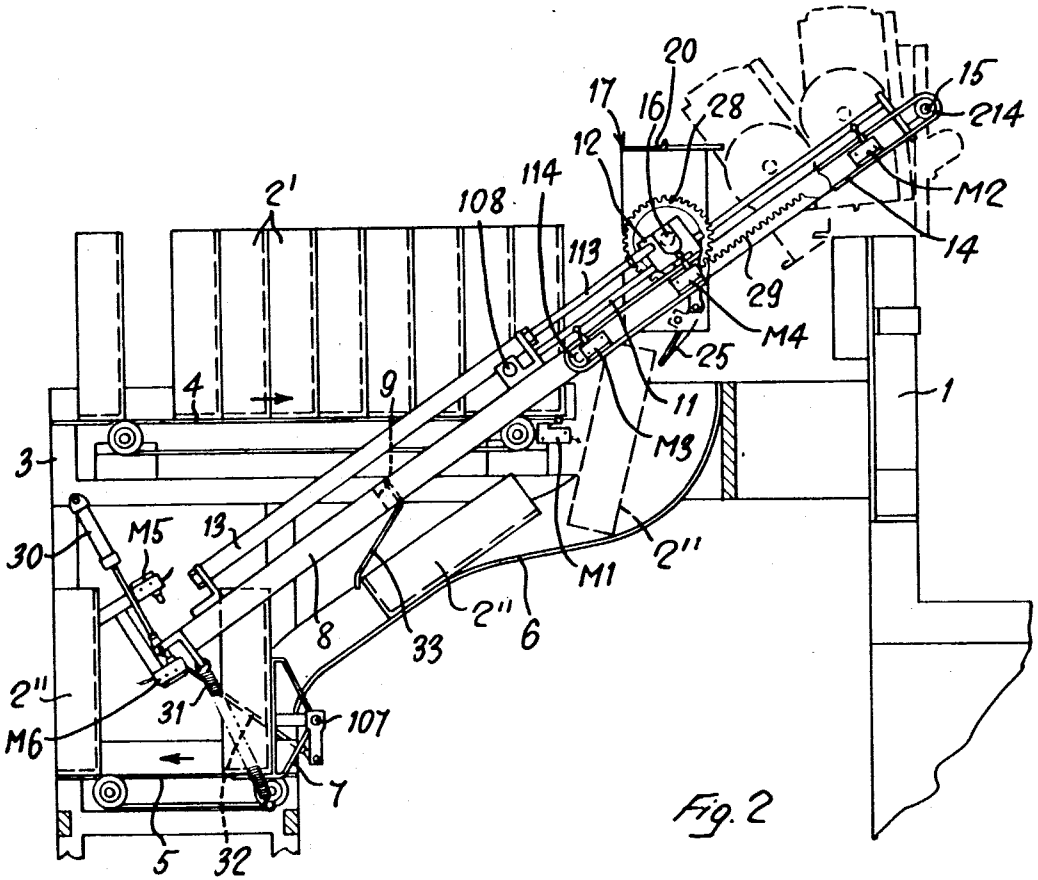
Figure 4:
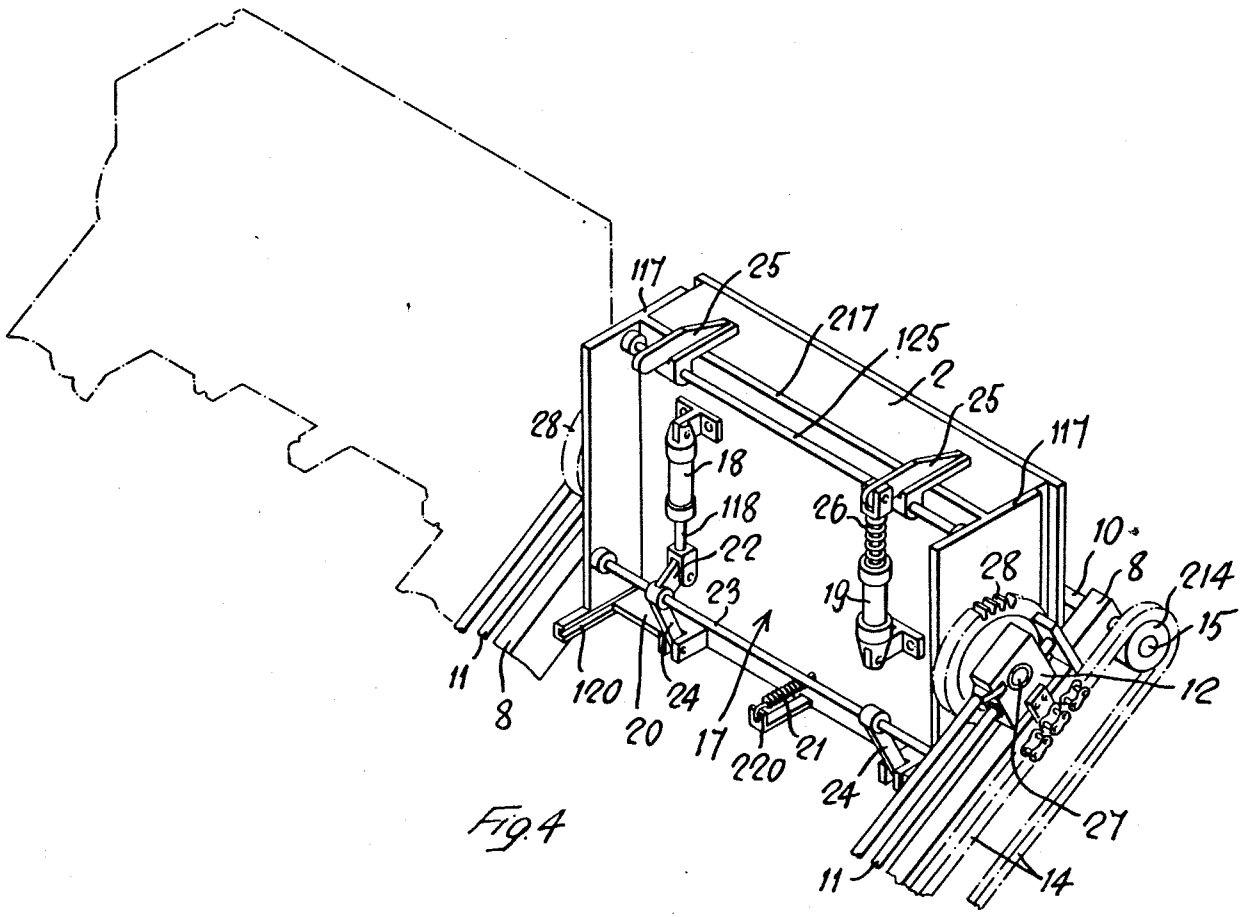
FIGS. 4 and 5 respectively are a perspective and a side elevational view showing the fore upper end of the feeder device according to the invention, with the tray-carrying casing.
Figure 7:
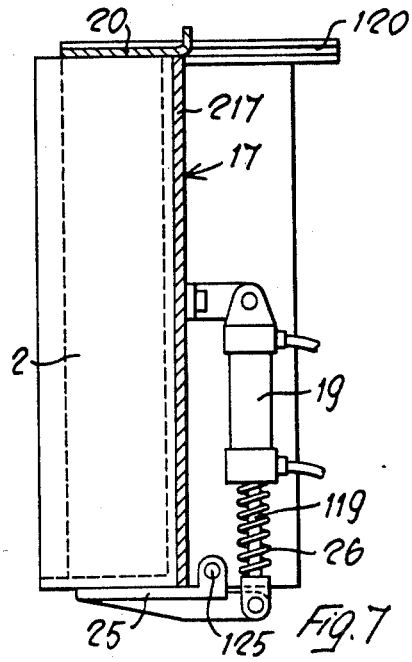
FIGS. 7 and 8 are cross-sectional views showing two different operative positions of the tray-carrying casing.
Figure 8:
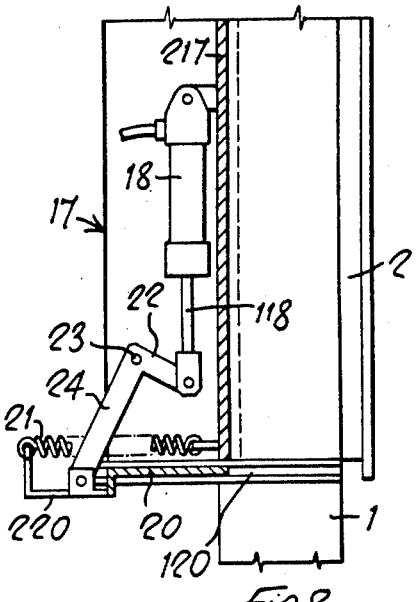
Figure 5:
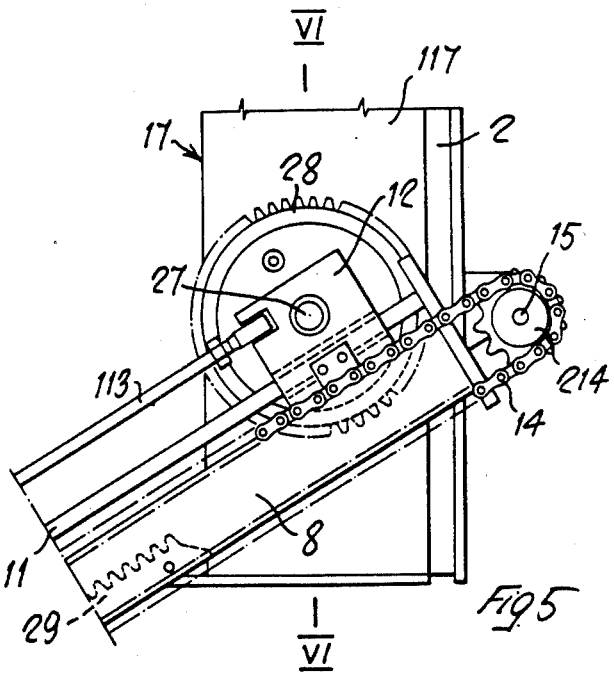

Between the two side frame members 8 of the loading/unloading frame there is arranged the tray-carrying casing 17 which in FIGS. 2, 5 and 7 is shown in the normal upstanding position, while in FIGS. 1, 4, 8 is shown in overturned position. The tray-carrying casing 17 has two sidewalls 117 and a transverse intermediate wall 217 that divides the said casing 17 (when referring to its normal upstanding position) into a rear hollow space being adapted for containing a tray 2, and into a fore hollow space containing two pneumatic cylinders 18 and 19. In the normal upstanding position of the tray-carrying casing, the open mouth of the tray 2 housed in said casing 17, is turned upward and can be closed by a gate 20 which is slidable within lateral guides 120 of casing 17, and which is shiftable by means of cylinder 18. More particularly, in the shown embodiment the gate 20 is biased toward the position for closing the casing 17 by an extension spring 21 fitted between the intermediate partition wall 217 of the tray-carrying casing 17 and an extension 220 of said gate 20, while it is moved into the position for opening the casing 17 by the cylinder 18, which is fastened to said intermediate partition wall. The stem 118 of said cylinder 18 is articulated to a lever arm 22 made integral with a layshaft 23 which is rotatably mounted between the two sidewalls 117 of casing 17. More than one lever arm 24 integral with the layshaft, are hingedly connected to gate 20, as it appears particularly in FIGS. 4 and 8.

In the aforementioned normal upstanding position of the tray-carrying casing 17, the closed bottom of tray 2 accommodated in casing 17, is turned in the downward direction, and the tray 2 is supported by rocking tray-holding arms 25 secured to a shaft 125 which is rotatably mounted between the sidewalls 117 of casing 17. Articulatedly connected to one of these tray-holding arms 25 (or to a lever integral with shaft 125) is the stem 119 of cylinder 19, which is fastened to the associated partition wall 217 of the tray-carrying casing 17, and which is associated with a return spring 26. This spring 26 tends to urge the tray-holding arms 25 into their active position, in which they support the tray 2, while the cylinder 19 is able to swing the tray-holding arms 25 into their inactive position, in which they are out of engagement with the tray 2, so that they let the tray fall out of the tray-carrying casing 17.

Figure 6:
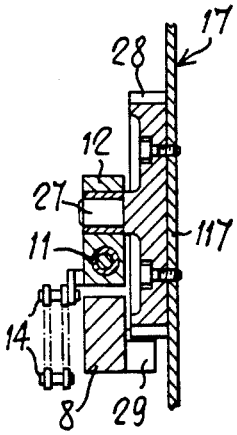
FIG. 6 is a sectional view on line VI—VI of FIG. 5, showing a detail of the device according to the invention.

The tray-carrying casing 17 is supported by both slides 12 so as to be overturnable around a transversely extending axis, by means of two co-axial stud-like shafts 27 extending outwardly from the sidewalls 117 of casing 17, and engaged in the slides 12, as shown particularly in FIG. 6. Onto the exterior of each sidewall 117 of the tray-carrying casing 17 a gearwheel 28 is fastened co-axially to the respective stud-like shaft 27, rotatably engaged in slide 12, which gearwheel is able to mesh with an associated rack 29 secured to the respective side frame member 8, and extending therealong over a certain distance.

The rear lower end of at least one of the side frame members 8 is connected through a pneumatic cylinder 30 and a return spring 31 to frame 3. The spring 31 tends to urge the loading/unloading oscillating frame 8—8, 9, 10 into an inclined angular position in which its upper fore end is at a higher level above the inlet opening of hopper 1, as shown in FIG. 2, while by counteracting the bias of return spring 31, the cylinder 30 will move the loading/unloading oscillating frame 8—8, 9, 10 into an inclined angular position in which the upper fore end of said frame 8—8, 9, 10 is at a lower level above the inlet opening of the hopper 1, as shown in FIG. 1. In these two angular positions of the loading inclined frame 8—8, 9, 10, the lower rear end of at least one of the side members 8 thereof cooperates with limit microswitches M5, M6.

Through a rod 32 the transferring rocker arm device 7 is articulatedly connected to at least one of the side members 8 of the loading/unloading oscillating frame 8—8, 9, 10, in such a manner that it will be angularly moved around the axis of pivot 107, about which it rocks, in relation to the angular movement of the loading/unloading oscillating frame 8—8, 9, 10, as will be more clearly disclosed hereinafter. To the under-side of the cross member 9 of the loading/unloading oscillating frame 8—8, 9, 10 there is fastened an abutment stop member 33 which is adapted for cooperating with the empty trays 2" descending along chute 6.

To describe the operation of the feeder device it is assumed, by way of an example, that the starting position is the one shown in FIG. 1 and for some details in FIGS. 3, 4, 5 and 8. In such a starting position, the loading/unloading oscillating frame 8—8, 9, 10 is located in the angular position in which its upper fore end is lowered toward hopper 1. The pair of slides 12 is situated in correspondence of the upper fore end of the loading/unloading frame 8—8, 9, 10, and the tray-carrying casing 17 is overturned. Therefore, the tray 2 carried by casing 17 has its mouth turned downward, and is connected thereby to the inlet opening of hopper 1. The gate 20 is in the position for opening the mouth of tray 2, so that the cigarettes descend from tray 2 into hopper 1.

On completion of the said emptying step of tray 2, a photocell F provided in hopper 1 near its inlet opening promotes the actuation of cylinder 30, that moves the loading/unloading oscillating frame 8—8, 9, 10 into the angular position in which its upper fore end is lifted up away from the inlet opening of hopper 1, as shown in FIG. 2. Thus, the tray-carrying casing 17 and the depleted tray 2" accommodated therewithin are lifted up and disengaged from the inlet opening of hopper 1. At the beginning of this angular movment of the loading-/unloading oscillating frame 8—8, 9, 10, the rear lower end thereof sets free the limit microswitch M5, whereby this microswitch promotes the actuation of cylinder 18, that shifts the gate 20 into the position in which it closes the mouth of the tray. At the end of the said angular movement of the loading/unloading oscillating frame 8—8, 9, 10, the lower rear end thereof activates the limit switch M6, which actuates both cylinders 13 in the direction in which their stems 113 are retracted. The two slides 12 are then caused to slide downward on guides 11 onto the respective side frame member 8, together with the tray-carrying casing 17. In the course of such a backward sliding of the slides 12, the gearwheels 28 integral with the sidewalls 117 of the tray-carrying casing 17, come to mesh with the respective rack 29, and by rolling thereon, these gearwheels cause the tray-carrying casing 17 to rotate around the transversal axis 27—27, in the anti-clockwise direction in FIG. 1. This rotation is concluded, owing to the fact that the gearwheels 28 come to be disengaged from the respective rack 29, when the tray-carrying casing 17 has performed a rotation of 180°, thus bringing the empty tray 2", which is accommodated therewithin, into its normal upstanding position, that is to say, with the tray mouth turned upwardly, as shown in FIGS. 2 and 7. After such an overturning of the tray-carrying casing 17 into its upstanding position, the abutment member 16 on slide 12 activates the intermediate microswitch M4, that operates the cylinder 19, whereby the tray-holding arms 25, up to now kept in the position for supporting the tray, are brought into their inactive position in which they let the empty tray fall out of the tray-carrying casing 17, down onto the underlying chute 6, as shown with dash lines in FIG. 2. This empty tray 2" continues its downward movement along chute 6, and is stopped by the abutment stop member 33 which in this angular position of the loading/unloading oscillating frame 8—8, 9, 10 extends into the path of the empty trays 2" arriving along chute 6.

The pair of slides 12 continues its downward movement on guides 11 arranged onto the side frame members 8 and keeps the now empty tray-carrying casing 17 in the normal up-standing position. At the end of this down travel of slides 12, the tray-carrying casing 17 slips over the first full tray 2' at stand-by on the feeding conveyor 4. At the same time, the slide 12 activates the limit microswitch M3. If the activation of said microswitch M3 is effected jointly with the activation of the pair of microswitches M1 at the leading end of the feeding conveyor 4, under the action of a full tray 2' at the end of its travel on said conveyor 4, the cylinder 19 will be operated in the direction for moving again the tray-holding arms 25 from their inactive position to their tray-supporting position, in which they engage from below the next full tray 2' and keep it into the tray-carrying casing 17. At the same time, or with a short time lag, the cylinders 13 will be operated in the direction for extending their stems 113, whereby the pair of slides 12 is caused to slide forward on guides 11 provided onto the side frame members 8, toward the upper fore ends thereof. During the said ascending movement of slides 12, the gearwheels 28 being made integral with the sidewalls 117 of the tray-carrying casing 17, come to be again in mesh with their respective racks 29, and by rolling thereon, they rotate the tray-carrying casing 17 in the clockwise direction in FIGS. 1 and 2, so as to overturn it by 180°, and thus capsize the full tray 2' accommodated therewithin. At the end of the upward travel of the pair of slides 12, the abutment member 16 of at least one slide 12 activates the limit microswitch M2 which promotes the operation of cylinder 30 in the direction for angularly moving the loading/unloading frame 8—8, 9, 10 from the position shown in FIG. 2, to the position shown in FIG. 1, thus lowering the upper fore end of said frame 8—8, 9, 10 toward the inlet opening of hopper 1. In this way, the capsized full tray 2 contained in the tray-carrying casing 17, is connected by its downwardly turned mouth with the inlet opening of hopper 1. On completion of the said angular movement of the loading/unloading frame 8—8, 9, 10, the limit microswitch M5 is activated, whereby this microswitch actuates the cylinder 18 so as to shift the gate 20 into the position for opening the mouth of the tray contained in the tray-carrying casing 17, thus causing the cigarettes to descend from this tray into the underlying hopper 1.

When on completion of the upward movement of the pair of slides 12 along with the tray-carrying casing 17, the loading/unloading frame 8—8, 9, 10 is angularly moved so as to have its upper fore end lowered toward the inlet opening of hopper 1, the transferring rocker arm device 7 is moved into its tray-withdrawing angular position, connected with chute 6, as shown in FIG. 1. The abutment stop member 33 is simultaneously lifted up, so that the empty tray 2'' having been retained thereby, continues its travel along chute 6 and is received in the transferring rocker arm device 7. With the loading/unloading frame 8—8, 9, 10 being subsequently swung into its angular position in which its upper fore end is lifted up from the inlet opening of the hopper 1, the abutment member 33 is again lowered into the position in which it stops the empty trays 2'' coming along in chute 6, while the transferring rocker arm device 7 is turned into its angular position connected to the conveyor 5 onto which the empty trays 2'' will be discharged, as illustrated in FIG. 2. From the transferring rocker arm device 7 the now upstanding empty tray 2'' is thus deposited onto the conveyor 5 which is caused to travel, for example by steps, simultaneously with the feeding conveyor 4, so that while a full tray 2' is being brought into withdrawal position in correspondence of the limit microswitches M1, the empty tray 2'' will be extracted from the transferring rocker arm device 7.

Of course the invention is not limited to the embodiment just described and shown, but can be widely changed and modified, the more so in construction and within the scope of technically equivalent solutions. Thus, for example, at least some of the microswitches M1–M6 might be replaced by any other sensors.

Moreover, to obtain the movement of slides 12, the pneumatic cylinders 13 might be replaced by reversible speed-down gears operating the chains 14. These chains will then perform not only a synchronizing function, but also a driving function. The lateral gearwheels which are made integral of the tray-carrying casing 17, can be replaced by sector gears.

What is claimed is:

1. An automatic feeder device for transferring articles from trays to a packing machine having a hopper with an inlet, by moving trays that are full of articles over the inlet and by discharging trays that are empty after the contents thereof have been released into the inlet, each tray having a mouth and a bottom, comprising:

a tray-carrying casing provided with a gate for closing the tray mouth and with tray-holding means cooperating with the bottom of the tray;

feeding means defining a feeding path directed toward said hopper for feeding said full trays;

discharging means defining a discharge path directed away from said hopper for discharging said empty trays, said discharge path being below said feeding path;

a loading-and-unloading inclined frame having an upwardly oriented fore end that is disposed above said inlet of said hopper and having longitudinal side members that extend laterally to said paths;

first means for swingably moving said frame about a transversely extending axis so that said frame moves between a first angular position wherein said fore end is lowered toward said inlet and a second angular position wherein said fore end is lifted from said inlet, said frame being more inclined when in said second angular position than in said first angular position;

second means for mounting said tray-carrying casing so that said casing is longitudinally slidable along said longitudinal side members and rotatable about an axis extending transversely between said longitudinal side members; and third means cooperating with said frame and said second means for moving said tray-carrying casing from an overturned upper position, wherein a tray carried by said casing is disposed over said inlet of said hopper with the mouth of the tray directed downward so that articles fall from the mouth into said hopper, through an upstanding intermediate position, wherein an empty tray is released from said casing onto said discharge path, to an upstanding lower position, wherein said casing receives a full tray from said feeding path, and then to said overturned upper position.

2. The device of claim 1, wherein said tray-carrying casing has a pair of sidewalls; wherein said second means comprises a pair of slides, each sliding on a respective side member, and two co-axial stud-like shafts, each shaft being affixed to a respective sidewall and being rotatably mounted on a respective slide; and wherein said third means comprises means for moving said slides to and fro along said side members, a gearwheel fastened on at least one sidewall co-axially to the respective stud-like shaft, and rack means secured to said loading-and-unloading frame for meshing with said at least one gearwheel.

3. The device of claim 2, wherein said means for moving said slides to and fro comprises means for kinematically connecting said slides to guarantee the synchronism of their movement.

4. The device of claim 3, wherein said means for moving said slides to and fro comprises a pair of idle wheels rotatably mounted onto each side member, an endless chain mounted on each pair of idle wheels, and means securing each slide to a chain, and wherein said means for kinematically connecting comprises means for connecting at least one idle wheel on one side member to an idle wheel on the other side member.

5. The device of claim 2, wherein said means for moving said slides to and fro comprises an actuating cylinder.

6. The device of claim 2, wherein said means for moving said slides to and fro comprises a pair of idle wheels rotatably mounted onto a side member, an endless chain mounted on said idle wheels, means securing a slide to said chain, and means for driving said chain.

7. The device of claim 1, wherein said feeding path has a leading end adjacent said frame, and wherein said discharging means comprises a lower conveyor, a chute extending from a point between said hopper and said leading end of said feeding path to said lower conveyor, and transfer rocking arm device means, arranged between said chute and said lower conveyor, for withdrawing an empty tray lying in a recumbent position from said chute and transferring the empty tray in an upstanding position onto said lower conveyor.

8. The device of claim 7, wherein said feeding means further comprises means kinematically connecting said transfer rocking device means with said loading-and-unloading frame.

9. In a cigarette-packing machine having a hopper with an inlet over which two cigarette trays are placed in aligned relationship across the width of the inlet, wherein each tray has a mouth and a bottom and wherein the descent of cigarettes into the hopper proceeds alternately, with one tray releasing cigarettes into the hopper until it is empty while the other tray is being replaced by a full tray, the improvement comprising;

a pair of automatic feeder devices which move trays that are full of cigarettes over the inlet and which discharge trays that are empty after the contents thereof have been released into the inlet, each automatic feeder device including a tray-carrying casing provided with a gate for closing the tray mouth and with tray-holding means cooperating with the bottom of the tray, feeding means defining a feeding path directed toward said hopper for feeding said full trays, discharging means defining a discharge path directed away from said hopper for discharging said empty trays, said discharge path being below said feeding path, a loading-and-unloading inclined frame having an upwardly oriented fore end that is disposed above said inlet of said hopper and having longitudinal side members that extend laterally to said paths, first means for swingably moving said frame about a transversely extending axis so that said frame moves between a first angular position wherein said fore end is lowered toward said inlet and a second angular position wherein said fore end is lifted from said inlet, said frame being more inclined when in said second angular position than in said first angular position, second means for mounting said tray-carrying casing so that said casing is longitudinally slidable along said longitudinal side members and rotatable about an axis extending transversely between said longitudinal side members, and third means cooperating with said frame and said first means for moving said tray-carrying casing from an overturned upper position, wherein a tray carried by said casing is disposed over said inlet of said hopper with the mouth of the tray directed downward so that articles fall from the mouth into said hopper, through an upstanding intermediate position, wherein an empty tray is released from said casing onto said discharge path, to an upstanding lower position, wherein said casing receives a full tray from said feeding path, and then to said overturned upper position.

* * * * *